US007346934B1

(12) United States Patent
Scott

(10) Patent No.: US 7,346,934 B1
(45) Date of Patent: Mar. 25, 2008

(54) DEVICE AND METHOD FOR SECURING A NECKTIE

(76) Inventor: Christopher P. Scott, 307 Prospect Ave., 2G, Hackensack, NJ (US) 07601

( * ) Notice: Subject to any disclaimer, the term of this patent is extended or adjusted under 35 U.S.C. 154(b) by 1143 days.

(21) Appl. No.: 10/331,844

(22) Filed: Dec. 31, 2002

Related U.S. Application Data

(60) Provisional application No. 60/397,252, filed on Jul. 20, 2002.

(51) Int. Cl.
*A41D 25/04* (2006.01)

(52) U.S. Cl. ..... 2/145; 24/49.1

(58) Field of Classification Search ..... 2/144–151, 2/152.1, 153–156; 24/66.2, 66.6, 49.1, 54, 24/65, 66.5, 66.4
See application file for complete search history.

(56) References Cited

U.S. PATENT DOCUMENTS 5,007,139 A * 4/1991 Ahern ..... 24/49.1
5,046,221 A * 9/1991 Walker ..... 24/66.2
5,235,730 A * 8/1993 Townsend ..... 24/66.2
5,979,021 A * 11/1999 Swift ..... 24/66.6

* cited by examiner

*Primary Examiner*—Tejash Patel
(74) *Attorney, Agent, or Firm*—Law Offices Of Mitchell P. Novick; Benjamin Appelbaum

(57) ABSTRACT

A device for securing a necktie to the front of a wearer's garment comprises a bar, sized to pass through a button hole and be retained behind it; a ring sized to allow the bar to pass therethrough; and a flexible connecting means joining the ring and the bar, the connecting means having a length sufficient to secure the necktie to the garment front, yet allow the secured necktie to move a distance away from the garment front; and the connecting means being of thickness sufficient to allow its passage though the button hole without interfering with the function of the button closure. The device is used in a method of securing the necktie to the garment's front, which comprises passing the ring between the necktie label and the posterior face, and moving the bar through the ring to encircle the label, and inserting the bar through the buttonhole.

20 Claims, 5 Drawing Sheets

DEVICE AND METHOD FOR SECURING A NECKTIE

CROSS-REFERENCES TO RELATED APPLICATIONS

This application claims the benefit, under 35 U.S.C. §119(e) of U.S. Provisional Application, Ser. No. 60/397,252, filed 20 Jul. 2002 by the applicant, and which is herein incorporated by reference in its entirety.

FIELD OF THE INVENTION

The present invention relates to a device for, and method of, securing a necktie to the front of a garment, such as a shirt or blouse. The device is reusable, and compatible with neckties having a horizontal label or loop on its' posterior face. The device does not puncture the fabric of the tie, and does not interfere with the aesthetic presentation of the tie's anterior face.

BACKGROUND OF THE INVENTION

Neckties are commonly worn by men, and occasionally by women. Although styles change, a common problem for the wearer is if the tie is not secured to the wearer's garment, generally the front of a shirt or blouse, the tie may blow in the wind, or become soiled when the wearer is eating, leans forward, and the loose tie contacts the wearer's meal.

The prior art contains numerous references to devices for securing a tie to a wearer's garment. Some devices, such as tie tacks, puncture the tie when attaching it to the garment. Tie clips (or tie bars) may damage the surface of the tie, or restrict movement of the wearer. Other devices have been described for individuals who want to attach a tie to their garment, but do not want any device to be visible when the tie is viewed by someone facing the individual, so as not to disrupt the visual effect of the tie.

For example, Helm (U.S. Pat. No. D49,184) discloses a handkerchief supporting device, comprising a loop and a clip connected by a chain.

Alvardo-Lopez (U.S. Pat. No. Des. 317,275) discloses a necktie holder comprising an open ring into which a tie label is inserted, and a button hole insertion rod, the open ring and insertion rod being connected by a chain. In the present invention, the flexible connecting means encircles the tie label, thereby securing the necktie.

Bower, Jr. (U.S. Pat. No. 3,494,003) discloses a necktie holder attached to the underneath fold of the outer appearing end of the necktie, and is attached to the garment by a bar inserted through a button hole.

Grant (U.S. Pat. No. 4,554,710) discloses a tie tack for flexibly securing a tie to the shirt of a wearer. The tie tack has a cross-bar member for insertion into the button hole of a shirt for securing the tack thereto. A flexible thread extends between the cross-bar and a releasable fastener. A second releasable fastener is attached to the back surface of the tie adjacent the wearer. When the tie includes a loop, label or such that allows the small back portion of the tie to pass therethrough for securing the two portions together, the fastener is attached to the back surface thereof. The fastener is permanently affixed to the back surface of the tie. The present invention, by contrast is removable and does not require permanent attachment to the tie.

Ray (U.S. Pat. No. 5,031,284) discloses a tie retaining device that attaches to the left and right side rear fold members of a tie. Embodiments of the device each have an elongated wire-like member having pointed tips on each of its ends for penetrating the rear fold members of the tie. A tethering chain has its one end attached to the wire-like member and its other end attached to a button-hole anchor bar that is detachably inserted into the button hole of a shirt. The present invention, in contrast, encircles the tie label and does not penetrate the fabric of the tie.

Swift (U.S. Pat. No. 5,979,021) discloses a necktie manager having a bar for insertion into a buttonhole of a shirt, a short chain and a wire clamping member which is formed of a fixed length of a spring-like metal. The clamping member grips the tie on the rear face of the tie, such that the necktie manager is generally not visible. The present invention encircles the tie label, thereby securing the necktie.

Several devices have been described that attach to the garment proximate a button, but which do not enter the wearer's garment. Such devices include:

U.S. Pat. No. 3,360,800 (Less) which discloses a tie anchor comprising an aperture which engages a shirt button, and a circular portion attached to the tie back, such that the tie anchor is not visible from the front.

Smith (U.S. Pat. No. 3,467,993) discloses a necktie holder comprising a loop that can surround a complete necktie, or the back piece of the necktie, and which comprises an opening through which a shirt button can pass, fastening the tie to the shirt.

Casstevens, Jr. et al. (U.S. Pat. No. 3,793,681) discloses a tie anchor designed to hold a tie in place by anchoring the device to the button threads, comprising a locking means to prevent the holder from slipping from anchoring engagement with the threads when in place, and a fold retaining structure connected with the anchoring portion and including an elongate horizontal clamp bar that is connected at one end with the anchoring portion and a retaining means carried at the other side of the anchoring portion and extending forwardly toward the free end of the horizontal clamp bar for retaining the folds in place.

Missakian (U.S. Pat. No. 3,529,327) discloses a tie holder of one-piece resilient wire construction having an elongated loop-like portion engageable with a shirt button and a pair of U-shaped members generally defining a loop. The members have individual legs which are in substantial alignment and provide free ends which overlap and which are bent to form pincers adapted to grip the back of a tie. The present invention encircles the tie label, thereby securing the necktie.

Several devices described in the prior art require that they be permanently affixed to the necktie. In U.S. Pat. No. 4,827,576 Prince, Jr. discloses a buttonslot necktie fastener which is permanently fastened to the back side of a necktie loop-label. The fastener is oriented parallel to the necktie allowing the narrow section of the necktie to be captured in between the wide section of the necktie and the loop-label with the permanently affixed buttonslot necktie fastener, which is then attached to a garment using two buttonholes.

Durante (U.S. Pat. No. 4,835,821) discloses a necktie fastening device having a loop pile strip with two button holes for fastening to a shirt front. The loop pile strip has an outer surface and an inner surface which has an open topped pocket attached thereto in order to place an article or the like to be hidden from sight. A hook pile strip is placed between the designer label and the necktie so that when the loop pile strip and the hook pile strip are in position to be mated surface to surface, the necktie is secured and the necktie fastening device is not visible from the front.

Swain (U.S. Pat. No. 4,920,579) discloses a tie restraint apparatus for holding a tie tail portion of a neck tie at the front surface of a shirt. The tie tail is an elongated end portion of a neck tie and includes a transversely extending fabric strip (loop, or label) which is secured at spaced apart sites to a back surface of the tail portion. The tie restraint apparatus includes an elongated plastic strip having an opening at each spaced apart location for support by attachment to spaced apart buttons on the front portions of the shirt. The plastic strip is permanently attached to the neck tie, and it is dimensioned to extend between the fabric strip and the tail portion of the neck tie for centrally positioning and restraining movement of the tail portion of the neck tie at the front portion of the shirt.

Graef (U.S. Pat. No. 5,216,785) discloses a tie fastener including three identical strips of flexible material joined together at one end. An inner strip is buttoned to a shirt, using two buttons; an outer strip is fed through the loop-label of the tie, and is secured to one of the buttons securing the inner strip. An optional intermediate strip interposed between the inner and outer strips serves to cover a shirt button and prevent the loop-label of the tie from catching on the button.

Campelia et al. (U.S. Pat. No. 5,245,708) disclose a method for using a neck apparel restraining device with a neck apparel item for restraining movement of the neck apparel, in which the restraining device comprises a soft pliable member having first and second elongated buttonhole openings proximate its first and second ends, respectively. The device is passed through the loop-label of a necktie. The longitudinal centers of the device's buttonhole openings are separated a predetermined distance for releasably engaging with first and second uniformly spaced fastening buttons on the front of the shirt of a wearer. The device permits vertical movement of the neck apparel along the restraining device.

Other devices to secure ties have been described. Chennault (U.S. Pat. No. 5,337,457) discloses a neckwear anchoring device which is received by a tie loop and attaches to the button threads of selected buttons on the shirt or blouse of the wearer. The device is made of a relatively flat material and has substantially symmetrical attachment members, which engage the button threads by sliding behind the button without having to insert the button through a buttonhole. The device allows limited horizontal and vertical movement of the tie, such that the tie is effectively anchored and lays flat and smooth on the wearer's garment.

Walker (U.S. Pat. No. 5,046,221) discloses a necktie holder comprising a flexible filament with two end portions, one end portion is affixed to the decorative strip of fabric on the back of the necktie and the other end portion intended to be secured in the nearest adjacent buttonhole on a shirt front. An embodiment of the device embodiment attaches to the tie by a clip mechanism; other embodiments are permanently attached to the tie by piercing the tie fabric.

Voiles (U.S. Pat. No. 5,353,438) discloses a method for restraining the tail of a necktie to the front of a shirt, using a device which is a longitudinal strip of flexible material with a sewn longitudinal button hole on one end and a circular hole on the other end. The device is attached to a button of the wearer's shirt, passed through the tie loop, and the other end of the device attached to the button.

McNamara discloses several embodiments of a tie restraint in U.S. Pat. Nos. Des. 399,171 and 6,131,200. An embodiment described in U.S. Pat. No. 6,131,200 comprises an upper end, a lower end, a body connecting the two ends, with the body containing a multiplicity of notch pairs. The lower end contains a loop entry into which the upper end is inserted, drawing the body through while capturing the label of the necktie within the loop formed thereby; the restraint includes a slot to fasten the restraint to a buttonhole.

Thus there is a need for a device to secure a necktie to the front of a wearer's garment, which device can be readily used and removed, without damaging the tie, which secures the tie near the garment front, allows movement of the tie, and which can be concealed from the view of one who is viewing the wearer. The present invention describes a device and method for securing a necktie to the front of a buttoned shirt.

The present invention describes a reusable device compatible with neckties having a horizontal label or loop on it's posterior face. The present invention does not puncture the fabric of the tie, and does not interfere with the aesthetic presentation of the tie's anterior face.

BRIEF SUMMARY OF THE INVENTION

The present invention comprises a device for securing a necktie to the front of a wearer's garment comprises a bar, sized to pass through a button hole and be retained behind it; a ring sized to allow the bar to pass therethrough; and a flexible connecting means joining the ring and the bar, the connecting means having a length sufficient to secure the necktie to the garment front, yet allow the secured necktie to move a distance away from the garment front; and the connecting means being of thickness sufficient to allow its passage though the button hole without interfering with the function of the button closure. The device is used in a method of securing the necktie to the garment's front, which comprises passing the ring between the necktie label and the posterior face, and moving the bar through the ring to encircle the label, and inserting the bar through the buttonhole.

Fixation of the necktie is accomplished by first passing the ring end of the invention behind the label affixed to the posterior face of the tie. The bar end of the invention is then passed through the ring, capturing the label within the flexible portion of the device. The bar end is then passed through the button hole of the shirt front, and the shirt re-buttoned. The figures illustrate a jewelry quality device, although simpler materials of construction could easily be substituted, since the device is rarely seen by anyone but the wearer.

The device and method of use just described circumvents the problems associated with typical tie-restraining products. By fixing the tie via its posterior label, it does not damage or interfere with the aesthetic attributes of the necktie. The flexible portion of the device also allows for the natural motion of the tie, relative to the wearer's shirt front, while preventing the necktie from moving askew to the point of being unfashionable or bothersome.

BRIEF DESCRIPTION OF THE SEVERAL VIEWS OF THE DRAWINGS

FIG. 2 illustrates insertion of the device between the posterior face of the necktie and the label, the direction of movement being shown by arrow A.

FIG. 3 illustrates insertion of the bar through the ring, to retain the label therein, the direction of movement being shown by arrow B.

FIG. 4 illustrates movement of the bar towards the buttonhole, the direction of movement being shown by arrow C.

DETAILED DESCRIPTION OF THE INVENTION

Figure 1:
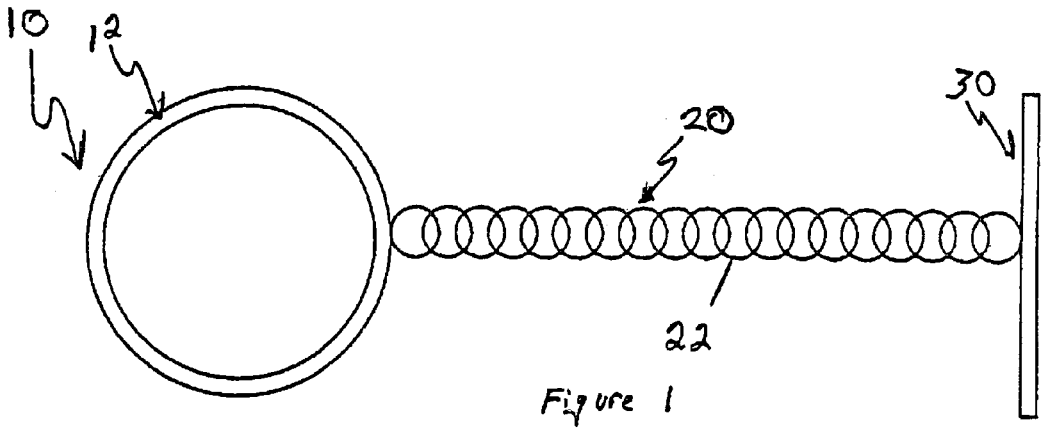
FIG. 1 illustrates an embodiment of the present invention.

An embodiment of the present invention is a device 10 (FIG. 1) for securing a necktie 50 to the front 62 of a wearer's shirt 60, of which shirt only selected elements are illustrated in the drawings (FIGS. 2-5). It is to be understood that while the drawings illustrate a man's shirt, the invention is also applicable to blouses worn by women.

Figure 2:
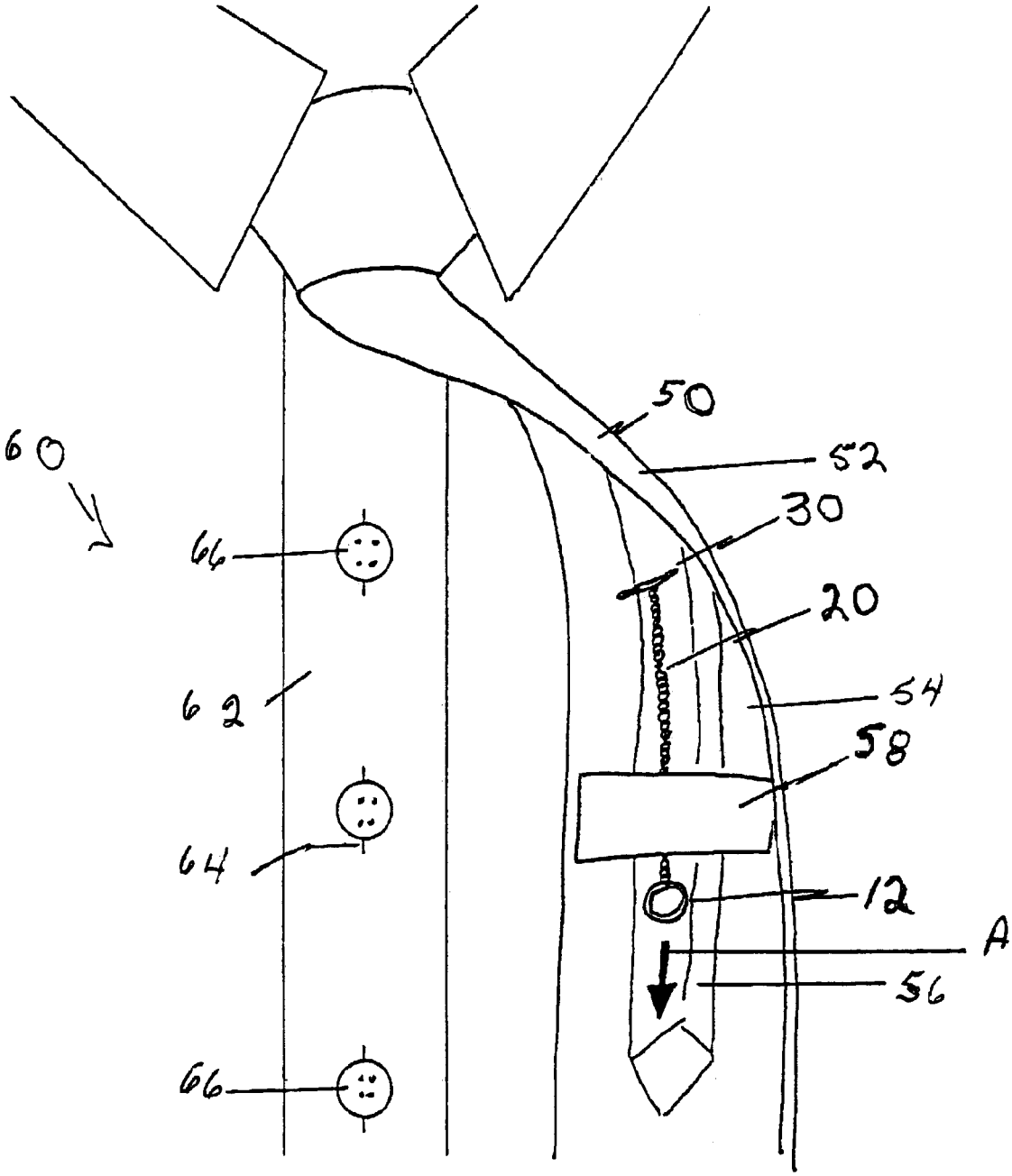
FIGS. 2-4 depict the sequence of steps used to attach a necktie to a garment front, using an embodiment of the present invention.
Figure 3:
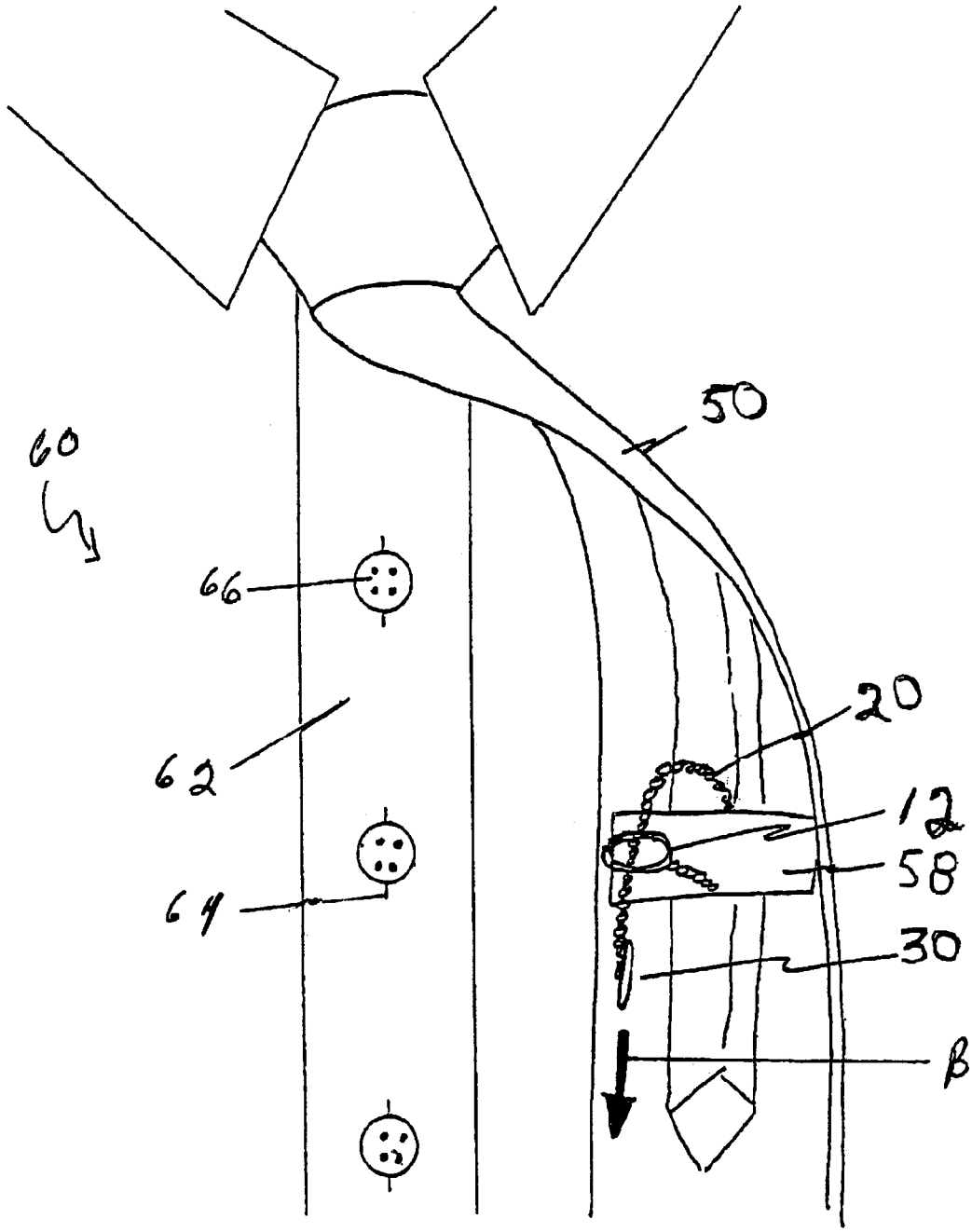

Referring to FIGS. 1-5 a necktie 50 is flexibly secured to the wearer's shirt front 62 by fixation of the necktie label 58 to one of the button holes 64 of the shirt. Generally, the tie will be secured to the button hole 64 closest to the label 58. As is well known, when a tie is knotted, the tie 50 comprises a anterior layer 52 and a thinner, posterior layer 56, with the label 58 being attached to the posterior face 54 (FIG. 2).

An embodiment of the present invention (FIG. 1) comprises three main members: a ring 12, a bar 30 and a thin, flexible member 20 connecting the ring 12 with the bar 30. In this embodiment, flexible member 20 is a chain comprising a plurality of links 22 connected to each other in a well-known fashion, and which are connected to both the ring 12 and bar 30 using means and methods known to those skilled in the art.

The ring 12 can be a closed ring as shown in FIG. 1, or it may be a split ring, such as of the type that is commonly used for keyrings and the like, or it may contain another type of opening therein, as known to those skilled in the art.

Figure 4:
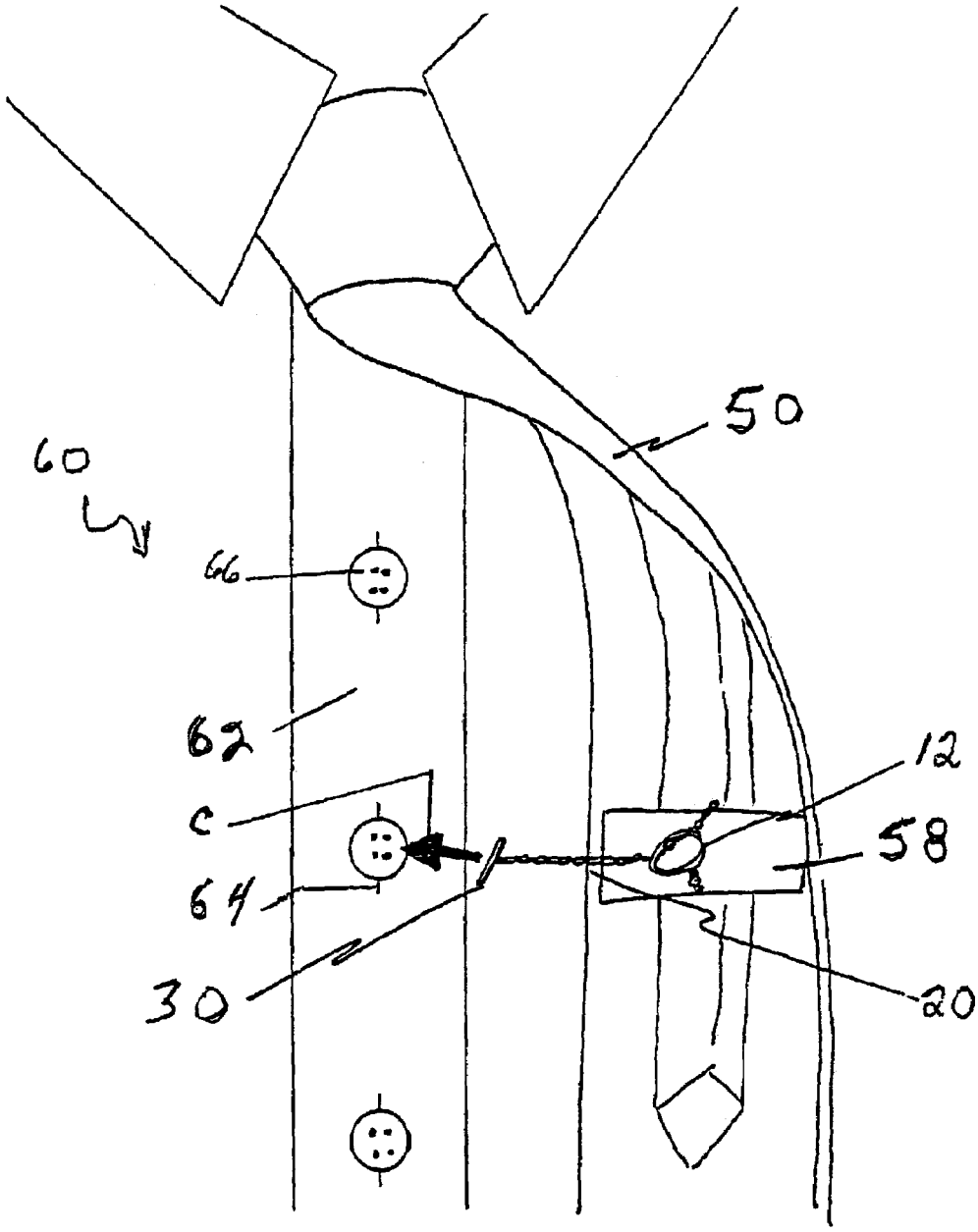
Figure 5:
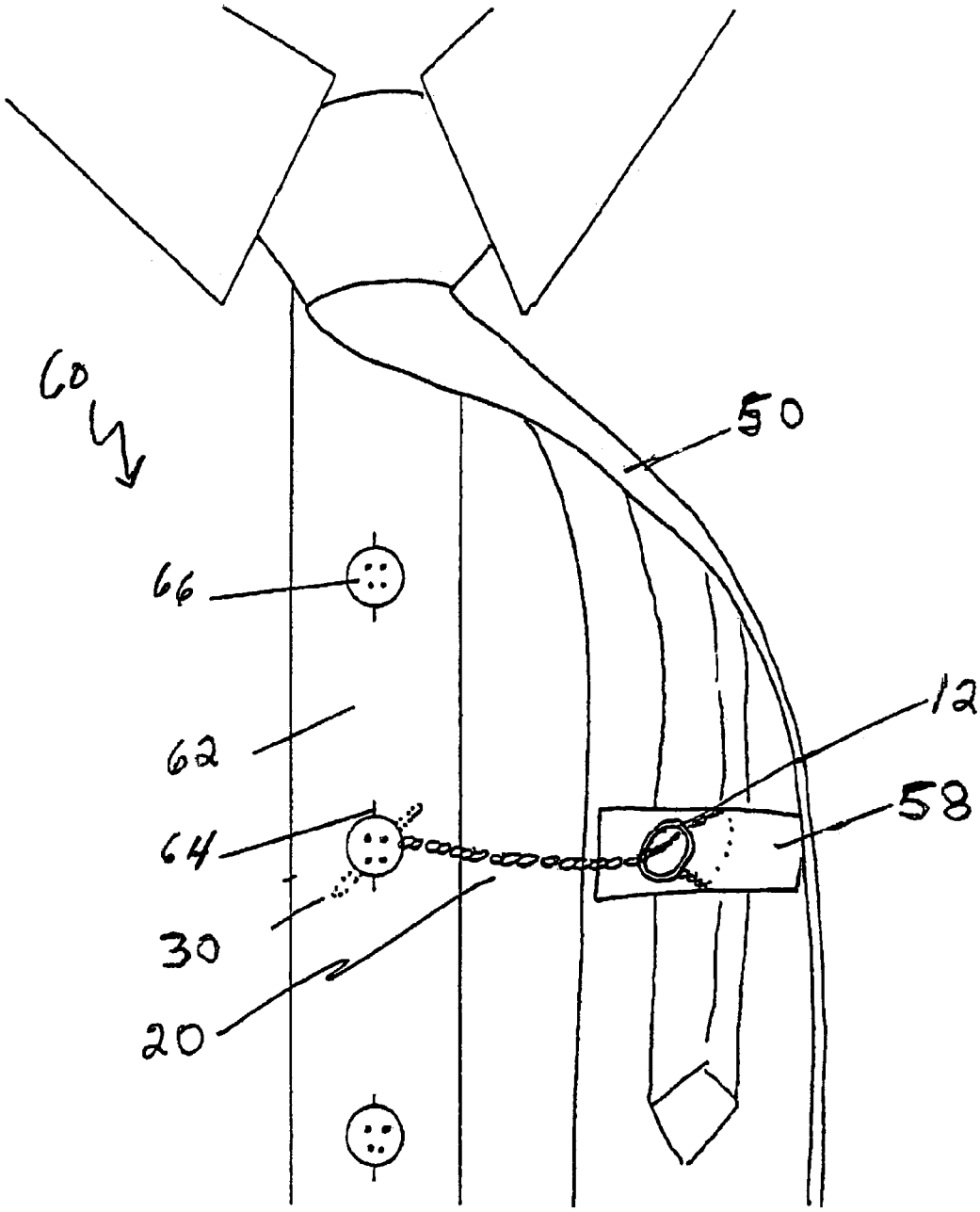
FIG. 5 is a perspective view of the present invention securing a necktie to the front of a garment. The bar 30 is shown in phantom behind the buttonhole.

Constraint of the necktie 60 is accomplished by first passing the open ring 12 of the device 10 between the tie label 58 and the posterior face 54 of the tie 50 (FIG. 2), in the direction shown by arrow A, such that a portion of flexible member 20 remains between the label 58 and the posterior face 54, and the bar remains a distance from the label 58, but still behind posterior face 54. The next step (FIG. 3) moves the bar 30 so that it is passed through the ring 12, as shown by the direction of arrow B, thereby encircling the tie label 58. The bar end 30 of device 10 is then passed through the button hole 64 of the shirt 50 (FIG. 4). FIG. 5 illustrates the final position of the device, with the position of the bar 30 being shown in phantom, and the necktie 50 is free to hang with sufficient freedom to allow natural movement relative to the shirt front 62 while preventing bothersome or excessive displacement of the tie. A plurality of buttons 66 are attached to the garment by threads, and to close the garment button 66 is passed through button hole 64 in a manner that is well known to those skilled in the art.

Figure 6:
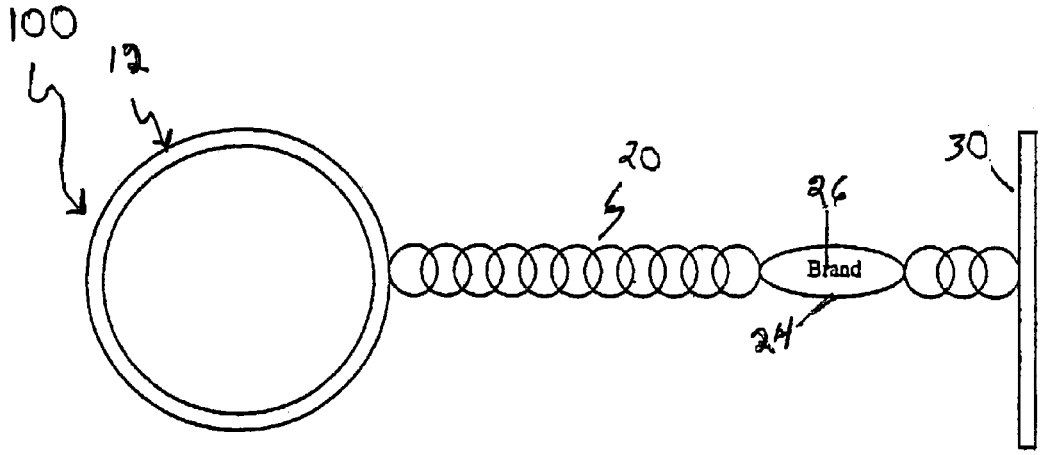
FIGS. 6 & 7 illustrate alternate embodiments of the present invention, comprising a member which can be used for aesthetic labeling.

A second embodiment 100 of the invention (FIG. 6) comprises the same elements as described for the embodiment shown in FIG. 1, except an additional member 24 is attached to links 22. Member 24 has a geometry which allows for indicia 26 to be displayed thereon. Member 24 may contain openings at its' ends through which a link 22 may be inserted therethrough, or an additional link (not shown) which engages links 22 of flexible member 20. The indicia may be, for example only and not intended to be any limitation, advertising material, a brand name of a product, the same of the manufacturer, directions for use, identification information, or other form of labeling, branding, promotion or the like. As shown in these figures, the additional member 24 is sized such that its addition will not interfere with the function of the device, as has been described for using the first embodiment of the present invention.

Figure 7:
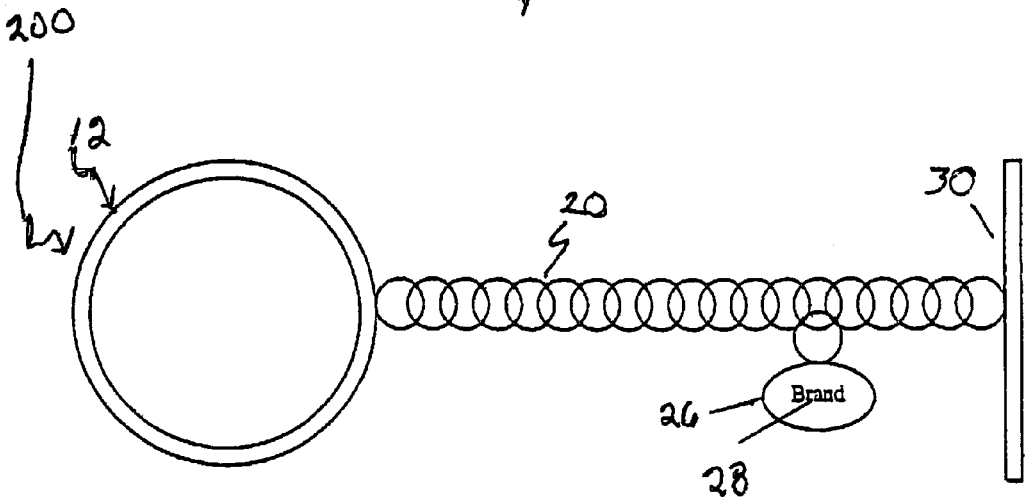

In a third embodiment 200 (FIG. 7) an additional member 28 is attached to the flexible member 20 by means of an additional link 22. Additional member 28 has a geometry which allows for indicia 26 to be displayed thereon. Member 28 may contain an opening along one edge through which link 22 may be inserted therethrough, or an additional link (not shown) which engages links 22 of flexible member 20. The indicia may be, for example only and not intended to be any limitation, advertising material, a brand name of a product, the same of the manufacturer, directions for use, identification information, or other form of labeling, branding, promotion or the like. As shown in these figures, the additional member 28 is sized such that its addition will not interfere with the function of the device, as has been described for using the first embodiment of the present invention.

The present invention can be manufactured from materials, or combinations of materials, known to those skilled in the art. Without limitation, examples of such materials include metals such as precious metals (gold, silver, sterling silver, platinum or the like, or combinations thereof); other metals such as stainless steel, copper, aluminum, or monel-metal; plastics; natural or synthetic fabrics, including paper, cardboard, cotton, cloth, silk, and the like.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

I claim:

1. A necktie restrainer for securing a necktie to a button hole in a garment, the necktie comprising a tie loop; the necktie restrainer consisting essentially of:

(a) a retaining means being sized to pass through the button hole and to be retained behind the button hole;

(b) an attachment means comprising a continuous loop, the continuous loop having an attachment opening therein, the attachment opening being sized to allow the retaining means to pass therethrough;

(c) a passthrough means being sized to pass through the tie loop, the passthrough means comprising one of the group consisting of the retaining means and the attachment means;

(d) a connecting means connected to the retaining means and the attachment means, the connecting means being sized to pass partially through the button hole and to pass partially through the tie loop;

the connecting means being structured such that an attachment loop may be formed by passing the passthrough means and part of the connecting means through the tie loop and passing the retaining means through the attachment means.

2. The necktie restrainer as described in claim 1, wherein the connecting means is a chain.

3. The necktie restrainer as described in claim 2, wherein the chain comprises a plurality of links.

4. The necktie restrainer as described in claim 3, wherein the connecting means further comprises an additional member attached between the links.

5. The necktie restrainer as described in claim 3, wherein the connecting means further comprises an additional member attached to one or more of the links.

6. The necktie restrainer as described in claim 4, wherein the additional member further comprises indicia.

7. The necktie restrainer as described in claim 1, wherein one or more components is constructed of metal.

8. The necktie restrainer as described in claim 1, wherein one or more components is constructed of plastic.

9. The necktie restrainer as described in claim 1, wherein one or more components is constructed of natural or synthetic nonmetallic materials, or combinations thereof.

10. A method of securing a necktie to a wearer's garment, the necktie comprising a posterior face facing the garment, and the posterior face comprising a tie loop, the method comprising:

(a) inserting a necktie restrainer for securing the necktie to the garment front, the necktie restrainer for securing the necktie comprising:

(1) a retaining means being sized to pass through the button hole and to be retained behind the button hole;

(2) an attachment means comprising a continuous loop, the continuous loop having an attachment opening therein, the attachment opening being sized to allow the retaining means to pass therethrough;

(3) a passthrough means being sized to pass through the tie loop, the passthrough means comprising one of the group consisting of the retaining means and the attachment means; and (4) a connecting means connected to the retaining means and the attachment means, the connecting means being sized to pass partially through the button hole and to pass partially through the tie loop;

the connecting means being structured such that an attachment loop may be formed by passing the passthrough means and part of the connecting means through the tie loop and passing the retaining means through the attachment means;

(b) forming the attachment loop by passing the passthrough means and part of the connecting means through the tie loop and passing the retaining means through the continuous loop;

(c) passing the retaining means through the button hole; and (d) retaining the retaining means behind the button hole.

11. The method as described in claim 10, wherein the connecting means is a chain.

12. The method as described in claim 11, wherein the chain comprises a plurality of links.

13. The method as described in claim 12, wherein the connecting means further comprises an additional member attached between the links.

14. The method as described in claim 12, wherein the connecting means further comprises an additional member attached to one or more of the links.

15. The method as described in claim 13, wherein the additional member further comprises indicia.

16. The method as described in claim 10, wherein one or more components is constructed of metal.

17. The method as described in claim 10, wherein one or more components is constructed of plastic.

18. The method as described in claim 10, wherein one or more components is constructed of natural or synthetic nonmetallic materials, or combinations thereof.

19. A necktie restrainer for securing a necktie to a garment, the garment comprising a button hole, the necktie having an anterior face, a posterior face, and a loop attached to the posterior face, the necktie restrainer consisting essentially of:

(a) a bar, sized to pass through the button hole and to be retained behind the button hole;

(b) a continuous ring, the ring being sized to allow the bar to pass therethrough;

(c) a connecting means, the connecting means connecting the bar and the ring;

the ring being passed between the loop and the posterior face, the connecting means being positioned therebetween;

the bar being inserted through the ring and the button hole, the connecting means encircling the loop, the connecting means having a thickness sufficient to allow passage though the button hole, a portion of the connecting means being retained within the button hole; and the connecting means further comprising a flexible body having a length sufficient to secure the necktie to the garment front, yet allow the secured necktie to move a distance from the garment.

20. The necktie restrainer as described in claim 19, wherein:

the loop comprises a label;

the connecting means comprises a chain, the chain comprising a plurality of links;

the connecting means further comprises an additional member attached between the links, the additional member comprising indicia; and one or more components of the necktie restrainer is constructed of materials selected from the group consisting of metal, plastic, natural or synthetic nonmetallic materials, and combinations thereof.

* * * * *